US011466855B2

(12) United States Patent
Freeman et al.

(10) Patent No.: US 11,466,855 B2
(45) Date of Patent: Oct. 11, 2022

(54) GAS TURBINE ENGINE COMBUSTOR WITH CERAMIC MATRIX COMPOSITE LINER

(71) Applicants: Rolls-Royce North American Technologies Inc., Indianapolis, IN (US); Rolls-Royce Corporation, Indianapolis, IN (US)

(72) Inventors: Ted J. Freeman, Danville, IN (US); Aaron D. Sippel, Zionsville, IN (US)

(73) Assignees: Rolls-Royce North American Technologies Inc., Indianapolis, IN (US); Rolls-Royce Corporation, Indianapolis, IN (US)

( * ) Notice: Subject to any disclaimer, the term of this patent is extended or adjusted under 35 U.S.C. 154(b) by 120 days.

(21) Appl. No.: 16/851,782

(22) Filed: Apr. 17, 2020

(65) Prior Publication Data

US 2021/0325043 A1 Oct. 21, 2021

(51) Int. Cl.
*F23R 3/00* (2006.01)
*F23R 3/60* (2006.01)

(52) U.S. Cl.
CPC ..... *F23R 3/007* (2013.01); *F05C 2253/04* (2013.01); *F05D 2300/6033* (2013.01); *F23R 3/60* (2013.01); *F23R 2900/00012* (2013.01)

(58) Field of Classification Search
CPC .. F23R 3/007; F23R 3/60; F23R 2900/00012; F23R 3/002
See application file for complete search history.

(56) References Cited

U.S. PATENT DOCUMENTS

| | | | |
|---|---|---|---|
| 4,614,082 | A | 9/1986 | Sterman et al. |
| 4,975,014 | A | 12/1990 | Rufin et al. |
| 5,090,857 | A | 2/1992 | Dunn |
| 5,363,643 | A | 11/1994 | Halila |
| 5,577,379 | A | 11/1996 | Johnson |
| 5,634,754 | A | 6/1997 | Weddendorf |
| 6,341,485 | B1 | 1/2002 | Liebe |
| 6,397,603 | B1 | 6/2002 | Edmondson et al. |
| 6,412,272 | B1 | 7/2002 | Titterton, III et al. |
| 6,907,920 | B2 | 6/2005 | Warburton et al. |
| 7,043,921 | B2 | 5/2006 | Hadder |
| 7,153,054 | B2 | 12/2006 | Arbona |
| 7,757,495 | B2 | 7/2010 | Bassagnet et al. |
| 7,845,174 | B2 | 12/2010 | Parkman et al. |
| 7,966,832 | B1 | 6/2011 | Lockyer et al. |
| 9,423,129 | B2 | 8/2016 | Graves et al. |
| 9,598,981 | B2 | 3/2017 | Salunkhe et al. |
| 9,612,017 | B2 | 4/2017 | Vetters |
| 9,879,605 | B2 | 1/2018 | Maurer et al. |
| 9,964,309 | B2 | 5/2018 | Corsmeier et al. |
| 2007/0031258 | A1 | 2/2007 | Campbell |
| 2008/0229750 | A1 | 9/2008 | Sipson |
| 2010/0189529 | A1 | 7/2010 | Steffier |

(Continued)

*Primary Examiner* — Katheryn A Malatek
(74) *Attorney, Agent, or Firm* — Barnes & Thornburg LLP

(57) ABSTRACT

A combustor adapted for use in a gas turbine engine includes a combustor shell comprising metallic materials. The combustor shell is formed to define an internal space. The combustor further includes a heat shield mounted to an axially aft surface of the combustor shell within the internal space and a combustor liner arranged to extend along inner surfaces of the combustor shell within the internal space. The combustor liner cooperates with the heat shield to define a combustor chamber.

19 Claims, 8 Drawing Sheets

(56) References Cited

U.S. PATENT DOCUMENTS

| | | | | |
|---|---|---|---|---|
| 2011/0120133 | A1* | 5/2011 | Rudrapatna | F23R 3/002 60/752 |
| 2016/0161121 | A1 | 6/2016 | Chang | |
| 2016/0186997 | A1 | 6/2016 | Sadil et al. | |
| 2016/0186999 | A1 | 6/2016 | Freeman et al. | |
| 2016/0215980 | A1 | 7/2016 | Chang | |
| 2018/0094811 | A1 | 4/2018 | Radwanski et al. | |
| 2018/0094812 | A1 | 4/2018 | Corsmeier | |
| 2018/0238181 | A1 | 8/2018 | Reynolds et al. | |
| 2018/0363505 | A1 | 12/2018 | Dziech | |
| 2019/0003710 | A1 | 1/2019 | Corsmeier | |
| 2020/0158344 | A1* | 5/2020 | Hu | F23R 3/50 |
| 2020/0284199 | A1* | 9/2020 | Morenko | F23R 3/007 |

* cited by examiner

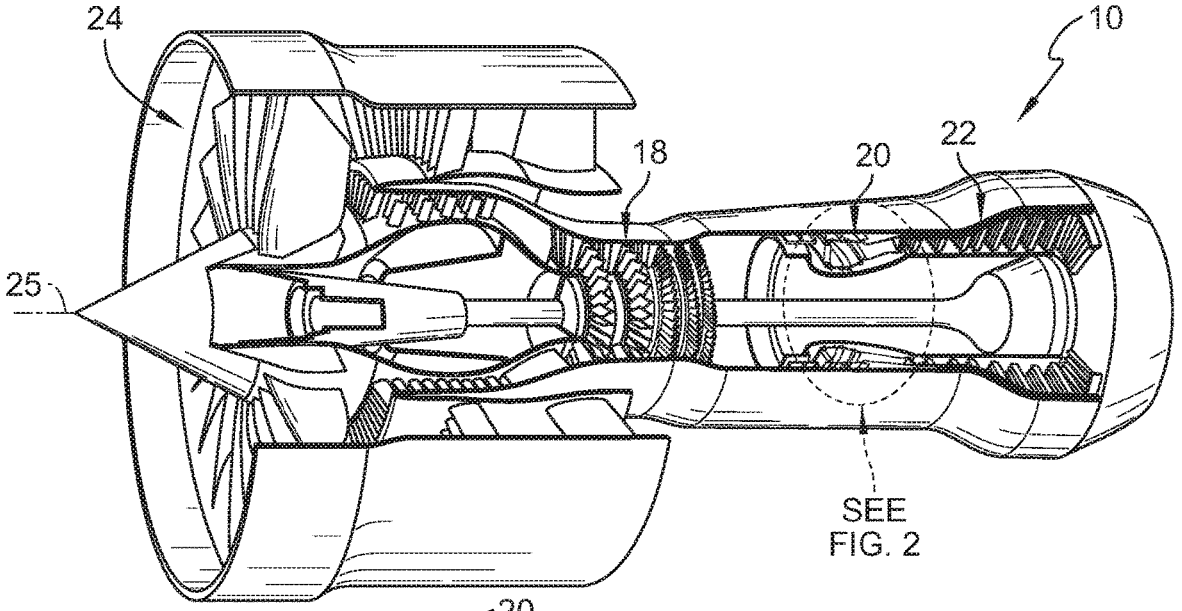
FIG. 1
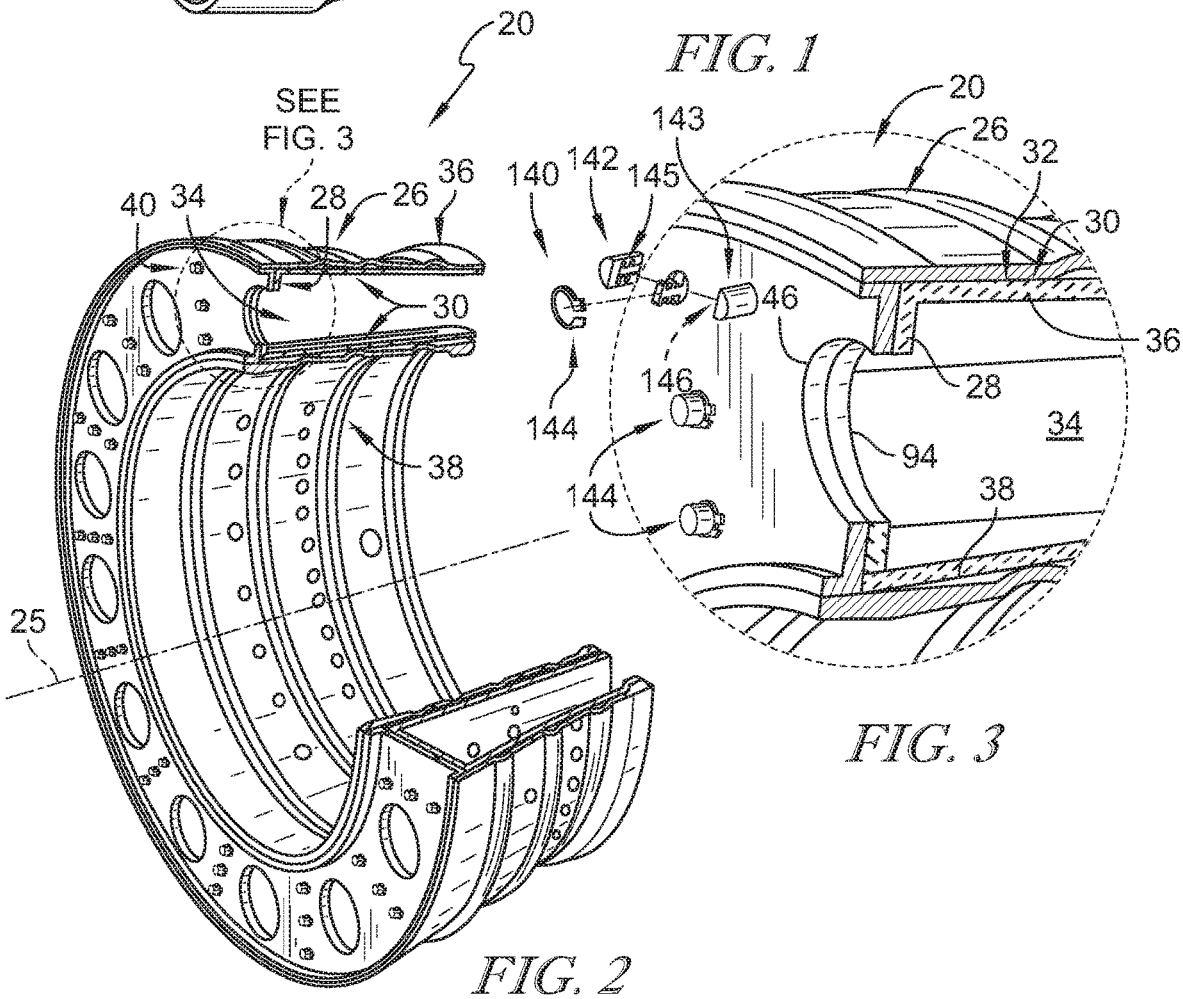
FIG. 3
FIG. 2

GAS TURBINE ENGINE COMBUSTOR WITH CERAMIC MATRIX COMPOSITE LINER

FIELD OF THE DISCLOSURE

The present disclosure relates generally to combustors used in gas turbine engines, and more specifically to a combustor including a metallic case and a heat shield.

BACKGROUND

Engines, and particularly gas turbine engines, are used to power aircraft, watercraft, power generators and the like. Gas turbine engines typically include a compressor, a combustor, and a turbine. The compressor compresses air drawn into the engine and delivers high pressure air to the combustor. The combustor is a component or area of a gas turbine engine where combustion takes place. In a gas turbine engine, the combustor receives high pressure air and adds fuel to the air which is burned to produce hot, high-pressure gas. After burning the fuel, the hot, high-pressure gas is passed from the combustor to the turbine. The turbine extracts work from the hot, high-pressure gas to drive the compressor and residual energy is used for propulsion or sometimes to drive an output shaft.

Combustors include heat shields that contain the burning fuel during operation of a gas turbine engine. The heat shields are designed and built to withstand high-temperatures induced during combustion. In some cases, heat shields may be made from metallic superalloys. In other cases, the heat shields may be made from ceramic matrix composites (CMCs) which are a subgroup of composite materials as well as a subgroup of technical ceramics. CMCs may comprise ceramic fibers embedded in a ceramic matrix. The matrix and fibers can include any ceramic material, in which carbon and carbon fibers can also be considered a ceramic material.

Combustors and turbines made of metal alloys often use significant cooling to be maintained at or below their maximum use temperatures. The operational efficiencies of gas turbine engines are sometimes increased with the use of CMC materials that use less cooling and have operating temperatures that exceed the maximum use temperatures of most metal alloys. The reduced cooling used by CMC combustor heat shields when compared to metal alloy combustion heat shields can permit greater temperature uniformity and can lead to reduced undesirable emissions.

One challenge relating to the use of CMC heat shields is that they are sometimes secured to the surrounding metal shell via metal fasteners. Metal fasteners can lose their strength and may even melt at CMC operating temperatures. Since the allowable operating temperature of a metal fastener is typically lower than the allowable operating temperature of the CMC, metal fasteners, and/or the area surrounding it, is often cooled to allow it to maintain its strength. Such configurations may undermine the desired high temperature capability of the CMC. Accordingly, new techniques and configurations are desired for coupling components, such as CMC, to the walls of enclosures experiencing high-temperature environments.

SUMMARY

The present disclosure may comprise one or more of the following features and combinations thereof.

According to one aspect of the present disclosure, a combustor for use in a gas turbine engine, includes a combustor shell made from metallic materials, a plurality of heat shields made from ceramic matrix composite materials, and a combustor liner made from ceramic matrix composite materials. The combustor shell is formed to define an internal space. The combustor shell may include an inner annular wall that extends circumferentially around an axis, an outer annular wall that extends circumferentially around the axis and the inner annular wall to provide an internal space radially between the inner annular wall and the outer annular wall, and a dome panel that extends circumferentially around the axis and radially between an axially-forward end of the inner annular wall and an axially-forward end of the outer annular wall.

In some embodiments, each heat shield is mounted to an axially aft surface of the dome panel and arranged to extend partway around the axis. The combustor liner may be arranged to extend along inner surfaces of the combustor shell within the internal space and to cooperate with the heat shield to define a combustor chamber. The combustor liner may include a plurality of outer liner tiles each arranged to extend only partway around the axis and axially away from the heat shield along the outer annular wall and a plurality of inner liner tiles each arranged to extend only partway around the axis and axially away from the heat shield along the inner annular wall.

In some embodiments, one of the inner liner tile and the outer liner tile is formed integrally with the heat shield such that an axially-forward end of the one of the inner liner tile and the outer liner tile is supported only by the heat shield relative to the combustor shell within the internal space and to block flow of gases between the heat shield and the one of the inner liner tile and the outer liner tile without a seal therebetween.

In some embodiments, the combustor further includes an inner support ring that extends circumferentially around the axis and contacts each of the inner liner tiles to block radial movement of the plurality of inner liner tiles and an outer support ring that extends circumferentially around the axis and contacts each of the outer liner tiles to block radial movement of the plurality of outer liner tiles.

In some embodiments, each outer liner tile is formed integral with a corresponding heat shield and each outer liner tile includes a tile panel and an aft support flange that extends axially-aft away from tile panel to engage with the outer support ring with a slip fit.

In some embodiments, each outer liner tile further includes a first circumferential flange on a first circumferential side of the body panel and a second circumferential flange on an opposite second circumferential side of the body panel and both the first circumferential flange and the second circumferential flange interlock with flanges of neighboring outer liner tiles to seal circumferentially between each outer liner tile.

In some embodiments, each inner liner tile includes a tile panel, a forward tile flange retained between the inner annular wall and the dome panel, and an aft tile flange retained by the inner support ring with a slip fit.

In some embodiments, each of the plurality of heat shields includes a shield panel and a plurality of attachments that extend axially forward from the shield panel and couple with the dome panel to mount and retain the heat shield and the corresponding one of the inner liner tile and the outer liner tile to the dome panel.

In some embodiments, each of the plurality of attachments extend through openings formed in the dome panel that are shaped to allow for thermal growth of the dome panel relative to the heat shield.

In some embodiments, each of the outer liner tiles and each of the inner liner tiles extends across an entire axial length of the internal space.

According to another aspect of the present disclosure, a combustor for use in a gas turbine engine includes a combustor shell, a heat shield, and a combustor liner. The combustor shell is made from metallic materials and is formed to define an internal space. The heat shield is made from ceramic matrix composite materials and is mounted to an axially aft surface of the combustor shell within the internal space. The combustor liner is arranged to extend along inner surfaces of the combustor shell within the internal space and to cooperate with the heat shield to define a combustor chamber.

In some embodiments, the combustor liner is made from ceramic matrix composite materials and includes an outer liner tile arranged to extend axially away from the heat shield and an inner liner tile arranged to extend axially away from the heat shield and spaced radially inward from the outer liner tile.

In some embodiments, at least one of the inner liner tile and the outer liner tile is formed integrally with the heat shield such that an axially-forward end of the at least one of the inner liner tile and the outer liner tile is supported only by the heat shield relative to the combustor shell within the internal space.

In some embodiments, the combustor further includes an inner support ring that extends circumferentially around an axis and contacts each of the inner liner tiles to block radial movement of the plurality of inner liner tiles and an outer support ring that extends circumferentially around the axis and contacts each of the outer liner tiles to block radial movement of the plurality of outer liner tiles.

In some embodiments, each outer liner tile is formed integral with a corresponding heat shield and each outer liner tile includes a tile panel and an aft support flange that extends axially-aft away from tile panel to engage with the outer support ring with a slip fit.

In some embodiments, each outer liner tile further comprises a first circumferential flange on a first circumferential side of the body panel and a second circumferential flange on an opposite second circumferential side of the body panel and both the first circumferential flange and the second circumferential flange interlock with flanges of neighboring outer liner tiles to seal circumferentially between each outer liner tile.

In some embodiments, each inner liner tile includes a tile panel, a forward tile flange retained by the combustor shell, and an aft tile flange retained by the inner support ring with a slip fit.

In some embodiments, each of the plurality of heat shields includes a shield panel and a plurality of attachments that extend axially forward from the shield panel and couple with the combustor shell to mount and retain the heat shield and the corresponding one of the inner liner tile and the outer liner tile to the combustor shell.

In some embodiments, the combustor shell includes a dome panel and each of the plurality of attachments extend through openings formed in the dome panel that are shaped to allow for thermal growth of the dome panel relative to the heat shield.

In some embodiments, the combustor further includes a liner skin made from metallic materials. The liner skin may include an inner skin panel located between the inner liner tile and the combustor shell and an outer skin panel located between the outer liner tile and the combustor shell. The inner and outer liner skins may be formed to include a plurality of cooling passages and may each include a hanger that grasps a respective aft end of the inner liner tile and the outer liner tile.

According to another aspect of the present disclosure, a method of manufacturing a combustor liner and a heat shield for a gas turbine engine includes providing a ceramic matrix composite preform comprising a plurality of ceramic matrix composite fibers, the preform having a rectangular portion and a plurality of protrusions that extend outwardly from the rectangular portion. The method may further include infiltrating the ceramic matrix composite preform with ceramic matrix material to densify the ceramic matrix composite preform. The method may further include molding the ceramic matrix composite preform by folding the rectangular portion in a first direction to provide a heat-shield preform and a tile preform and by folding each of the protrusions in a second direction away from the tile preform. The method may further include solidifying the ceramic matrix composite preform to provide the combustor liner and the heat shield integral with the combustor liner.

In some embodiments, the step of molding the ceramic matrix composite preform includes shaping the heat-shield preform and the tile preform to extend at least partway around an axis.

In some embodiments, the plurality of protrusions includes a first protrusion arranged on a first circumferential edge of the heat-shield preform and a pair of second protrusions arranged on an opposite second circumferential edge of the heat shield preform.

In some embodiments, the method may further include a step of machining a central aperture in the heat shield after the step of solidifying the ceramic matrix composite preform.

These and other features of the present disclosure will become more apparent from the following description of the illustrative embodiments.

BRIEF DESCRIPTION OF THE DRAWINGS

FIG. 1 is a partial perspective view of a gas turbine engine, in accordance with the present disclosure, showing that the gas turbine engine includes a compressor, a combustor, a turbine, and a fan that is driven in rotation about a central reference axis by the turbine upon combustion of fuel and pressurized air in the combustor;

FIG. 2 is an enlarged perspective view of the combustor from FIG. 1 with portions cut away showing that the combustor includes (i) a combustor shell made from metallic materials and defining an internal space, (ii) a heat shield arranged along an axially forward end of the combustor shell, and (iii) a combustor liner that is arranged along radially inner and outer walls of the combustor shell;

FIG. 3 is an enlarged perspective view of a portion of the combustor from FIG. 2 showing that the heat shield is formed integral with an outer liner tile included in the combustor liner and showing that the heat shield includes a plurality of integral attachment posts that are arranged to couple with retainer units to mount the heat shield and the integral outer liner tile to the combustor shell;

DETAILED DESCRIPTION

Figure 4:
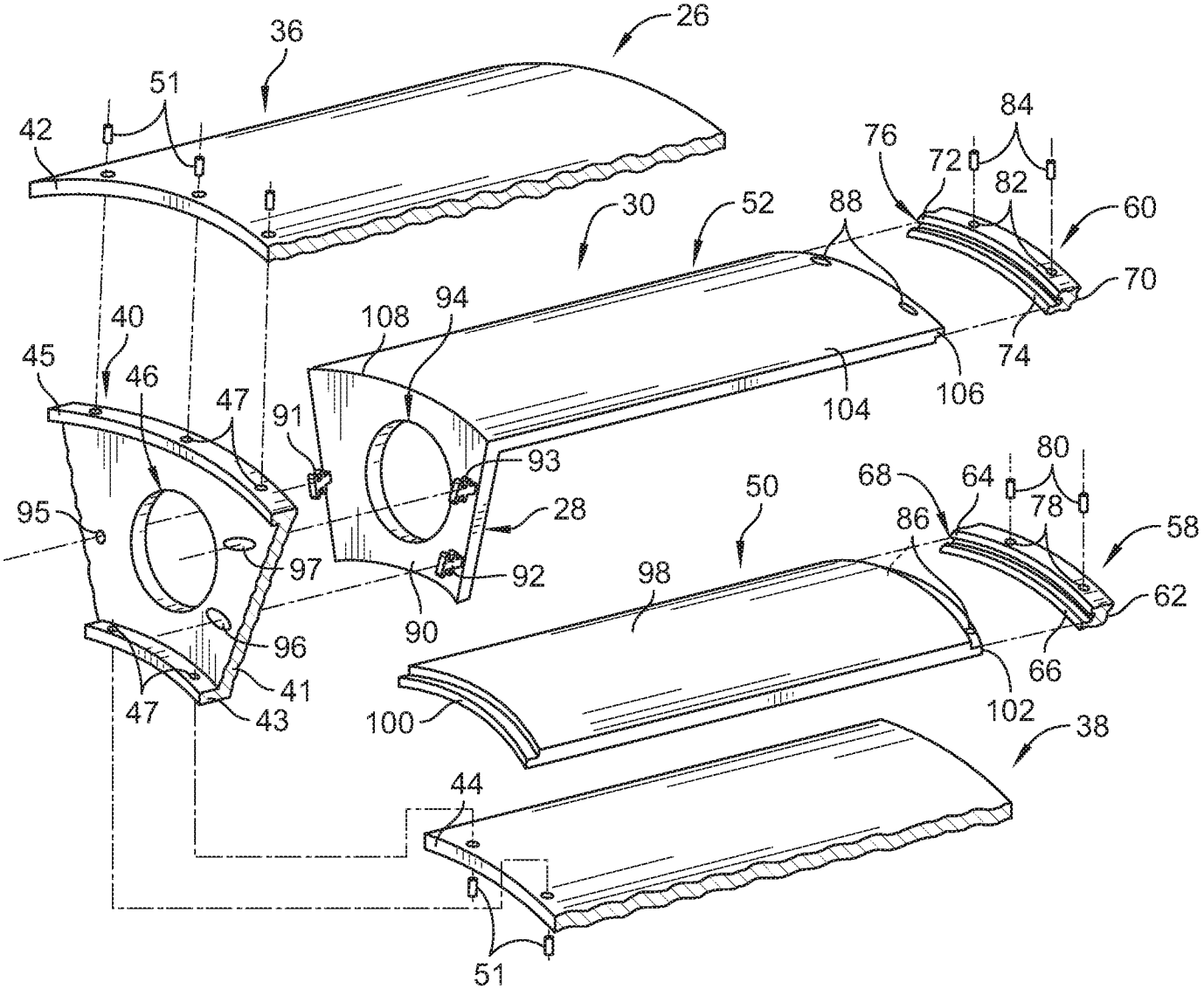
FIG. 4 is an exploded assembly view of a portion of the combustor from FIGS. 1-3 showing that the heat shield and the combustor liner are arranged to extend only partway around an axis of the gas turbine engine and the combustor further includes inner and outer support rings that couple with the combustor liner to retainer each combustor liner tile together around the axis.

For the purposes of promoting an understanding of the principles of the disclosure, reference will now be made to a number of illustrative embodiments illustrated in the drawings and specific language will be used to describe the same.

A gas turbine engine 10, in accordance with the present disclosure, is shown in FIG. 1. The gas turbine engine 10 includes a compressor 18, a combustor 20, and a turbine 22. The compressor 18 is configured to pressurize air and delivers the pressurized air to the combustor 20 during operation. Fuel is injected into the combustor 20 and is ignited with the pressurized air to produce hot, high pressure gases which are discharged from the combustor 20 toward the turbine 22. The hot, high pressure gases drive rotation of rotating components (i.e. blades and disks) in the turbine 22 about an axis 25 which drives rotation of a fan 24 to provide thrust for the gas turbine engine 10.

The combustor 20 operates at extremely high temperatures when the gas turbine engine 10 is in operation. The combustor 20 includes a combustor shell 26 made from metallic materials, a plurality of heat shields 28 made from ceramic matrix composite materials, and a combustor liner 30 made from ceramic matrix composite materials as shown in FIGS. 2 and 3. The combustor shell 26 is mounted within the gas turbine engine 10 upstream of the turbine 22 and is formed to define an internal space 32. The plurality of heat shields 28 and the combustor liner 30 are coupled to the combustor shell 26 and are arranged along inner surfaces of the combustor shell 26 within the internal space 32 to block hot gases from coming into contact with the combustor shell 26 during operation of the gas turbine engine 10.

Each heat shield 28 extends only partway around the central reference axis 25 as shown in FIG. 4. The combustor liner 30 may also be segmented such that at least a portion of the combustor liner 30 extends only partway around the axis 25 with a corresponding one of the plurality of heat shields 28. Cumulatively, the plurality of heat shields 28 and the combustor liner 30 cooperate to cover substantially all of the inner surfaces defining the internal space 32 and to define a combustion chamber 34.

Combustion of fuel and gases occurs in the combustion chamber 34 and produces hot gases which, absent the plurality of heat shields 28 and the combustor liner 30, may damage the combustor shell 26 and affect the performance of the gas turbine engine 10. The ceramic matrix composite materials forming the plurality of heat shields 28 and the combustor liner 30 are able to withstand much higher temperatures as compared to the metallic materials forming the combustor shell 26. As such, the plurality of heat shields 28 and the combustor liner 30 are arranged along the inner surfaces of the combustor shell 26 defining the internal space 32 to define the combustion chamber 34 and block the hot gases from reaching the combustor shell 26.

Figure 5:
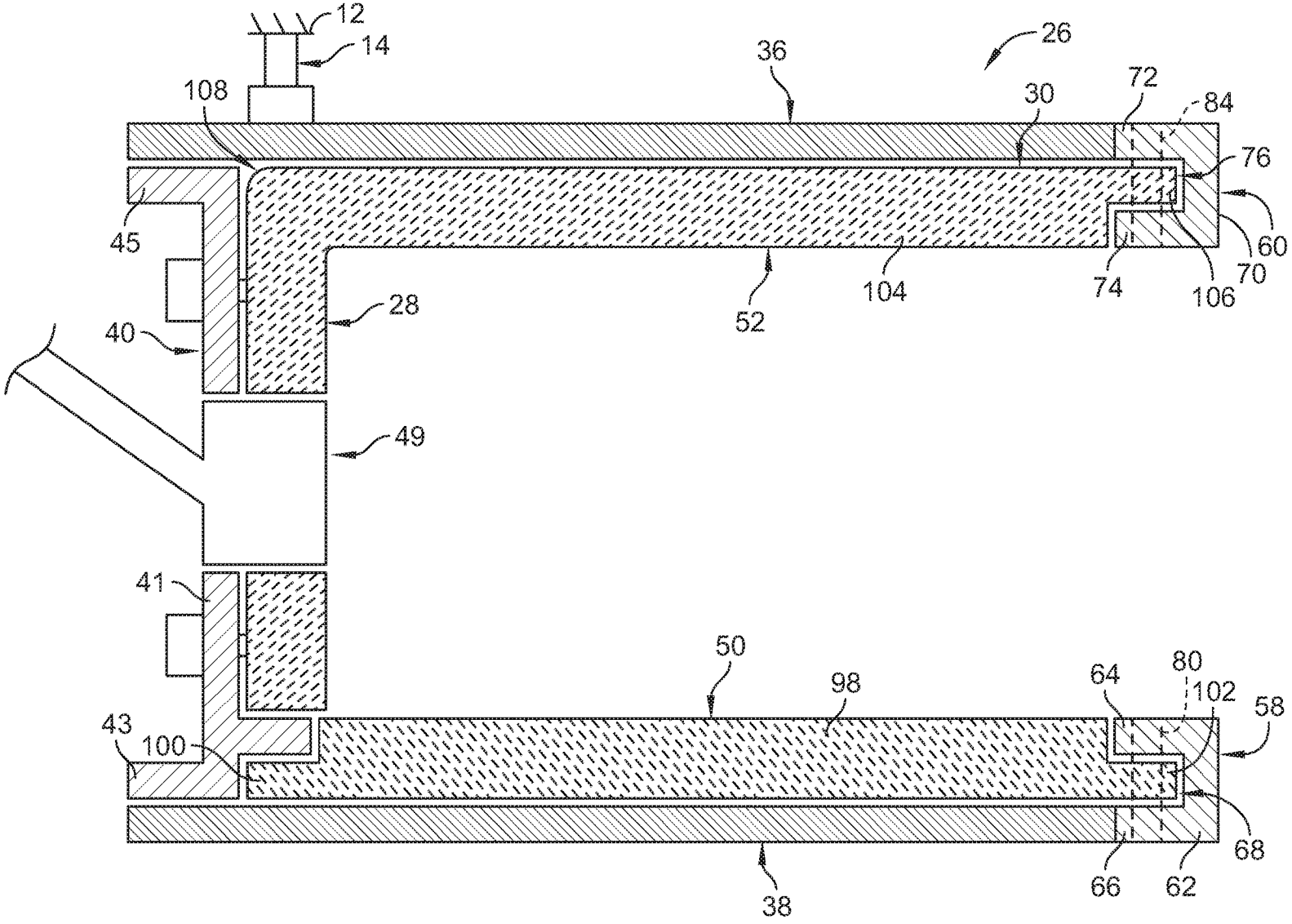
FIG. 5 is a cross sectional view of the combustor taken along line 5-5 in FIG. 2 showing the combustor grounded at an axially-forward end of the combustor and the heat shield installed on an inner surface of the dome panel and retained to the dome panel to support an axially forward end of the outer liner tile and showing the support rings installed at an axially aft end of the combustor liner.

The combustor shell 26 includes an outer wall 36, an inner wall 38 spaced radially apart from the outer wall 36, and a dome panel 40 arranged to extend between and interconnect the outer wall 36 and the inner wall 38 as shown in FIGS. 3 and 5. The outer wall 36, the inner wall 38, and the dome panel 40 are annular such that they extend circumferentially around the axis 25. The inner wall 38 is arranged radially inward from the outer wall 36 to provide the internal space 32 between the outer wall 36 and the inner wall 38. The dome panel 40 is coupled to axially-forward ends 42, 44 of the outer wall 36 and the inner wall 38 to provide the internal space 32 axially aft of the dome panel 40.

The outer wall 36 and the inner wall 38 are mounted to respective radial ends of the dome panel 40 with a plurality of fasteners 35 and extend axially aft away from the dome panel 40 as suggested in FIG. 4 and shown in FIG. 5. The dome panel 40 includes a main sheet 41, an inner flange 43, and an outer flange 45. The main sheet 41 is formed to include a plurality of fuel nozzle apertures 46 that open into the internal space 32. The inner and outer flanges 43, 45 are formed to include openings 47 that receive fasteners 51 to couple the outer and inner walls 36, 38 to the dome panel 40.

Fuel nozzles 49 extend through the fuel nozzle apertures 46 and into or adjacent to the combustion chamber 34. The fuel nozzles 49 are configured to spray fuel flowing therethrough for mixture with air and for combustion within the combustion chamber 34. The hot gases produced by the combustion reaction flow aft through the combustion chamber 34 until they exit the combustion chamber 34 toward the turbine 22 where the hot gases are used to drive rotation of components in the turbine 22.

The combustor 20 is grounded or fixed within the gas turbine engine 10 to an outer case 12 as suggested in FIG. 5. A forward end of the outer wall 36 of the combustor shell 26 is mounted to the outer case 12 by a boss 14. In some embodiments, the inner wall 38 may be used to ground the combustor 20. A plurality of bosses 14 spaced circumferentially apart from one another around axis 15 may be used to mount the combustor 20 to the gas turbine engine 10.

The combustor liner 30 includes a plurality of inner liner tiles 50 and a plurality of outer liner tiles 52 as shown in FIGS. 4 and 5. The plurality of inner liner tiles 50 extend along an outer surface 54 of the inner wall 38 which defines a radially inner boundary of the internal space 32. The plurality of outer liner tiles 52 extend along an inner surface 56 of the outer wall 36 which defines a radially outer boundary of the internal space 32. Each of the inner liner tiles 50 is separate from the heat shields 28. Each of the outer liner tiles 52 is formed integral with a corresponding one of the plurality of heat shields 28 to minimize interfaces between the plurality of heat shields 28 and the combustor liner 30 while accommodating thermal growth of the combustor shell 26, each of the heat shields 28, and the combustor liner 30. The inner liner tile 50 may move radially relative to the heat shield 28 to avoid binding stresses on the combustor liner 30 since those components are separate from one another.

The combustor 20 further includes an inner support ring 58 engaged with each of the inner liner tiles 50 and an outer support ring 60 engaged with each of the outer liner tiles 52 as suggested in FIG. 4 and shown in FIG. 5. The inner support ring 58 and the outer support ring 60 are made from metallic materials and are each formed as a full hoop that extends continuously around axis 25. The inner support ring 58 is configured to support an axially aft end of each of the inner liner tiles 50 to block the inner liner tiles 50 from moving radially relative to one another (i.e. fluttering relative to one another). The outer support ring 60 is configured to support an axially-aft end of each of the outer liner tiles 52 to block the outer liner tiles 52 from moving radially relative to one another (i.e. fluttering relative to one another). The inner support ring 58 may be fixed to the inner wall 38 and the outer support ring 60 may be fixed to the outer wall 36.

The inner support ring 58 and the outer support ring 60 are substantially similar to one another except that the outer support ring 60 has a larger diameter than the inner support ring 58 such that the outer support ring 60 is located radially outward from the inner support ring 58 as shown in FIG. 5. The inner support ring 58 includes a ring body 62, an outer flange 64, and an inner flange 66 spaced from the outer flange 64 to provide a channel 68 radially therebetween. The outer support ring 60 includes a ring body 70, an outer flange 72, and an inner flange 74 spaced from the outer flange 72 to provide a channel 76 radially therebetween. At least one of the inner and outer flanges 64, 66 of the inner support ring 58 is formed to include radially extending openings 78 that receive fasteners 80. At least one of the inner and outer flanges 72, 74 of the outer support ring 60 is formed to include radially extending openings 82 that receive fasteners 84. Openings 78, 82 and fasteners 80, 84 are optional.

The channels 68, 76 open in a forward direction toward the combustor liner 30 to receive portions of each of the inner liner tiles 50 and the outer liner tiles 52, respectively, as shown in FIG. 5. The fasteners 80, 84 extend through corresponding openings 86, 88 formed in the inner and outer liner tiles 50, 52 to secure the inner support ring 58 to each of the inner liner tiles 50 and to secure the outer support ring 60 to each of the outer liner tiles 52. The openings 86, 88 are elongated in the circumferential direction to allow the fasteners 80, 84 and the support rings 58, 60 to move relative to the combustor liner 30 as the metallic materials of the support rings 58, 60 grow at a rate that is greater than the CMC materials of the combustor liner 30 during operation.

Although the combustor 20 includes a plurality of heat shields 28 in the illustrative embodiment, each of the heat shields 28 are substantially similar to one another. Accordingly, only one heat shield 28 is discussed herein. The heat shield 28 is formed into a one-piece CMC component and includes a shield panel 90 and a plurality of attachments 91, 92, 93 that are integral with the shield panel 90 as shown in FIG. 4. The shield panel 90 borders an inner surface of the combustor shell 26 to protect the combustor shell from the burning gases in the combustion chamber 34 and is formed to include a fuel-nozzle aperture 94 that receives a corresponding fuel nozzle 49 as shown in FIG. 5. The plurality of attachments 91, 92, 93 are arranged to extend through corresponding openings 95, 96, 97 formed in the main sheet 41 of the dome panel 40. The opening 95 on a first circumferential side of the dome panel 40 is circular while the other two openings 96, 97 are elongated along axes that extend through a center of opening 95. The positioning and shape of the openings 95, 96, 97 allow the dome panel to move relative to the heat shield 28 as the dome panel 40 grows thermally at a rate that is greater than the heat shield 28 during operation.

Each attachment post 91, 92, 93 is coupled with a retainer unit 140 on a forward side of the dome panel 40 to retain the heat shield 28 to the dome panel 40 as shown in FIG. 3. Each retainer unit 140 includes a first retainer piece 142, a second retainer piece 143, and a clip 144. Each retainer piece 142, 143 is formed to include a cutout 145, 146 that matches a shape of the attachments 91, 92, 93. The retainer pieces 142, 143 combine to enclose the attachments 91, 92, 93 and are held together by the clip 144 to block axial movement of the attachments 91, 92, 93, out of openings 95, 96, 97.

Each of the plurality of inner liner tiles 50 extends axially aft from the dome panel 40 and runs the entire axial length of the internal space 32 as shown in FIGS. 4 and 5. Although the combustor 20 includes a plurality of inner liner tiles 50, each of the inner liner tiles 50 is substantially similar to one another. Accordingly, only one inner liner tile 50 is discussed herein. The inner liner tile 50 includes a tile panel 98 a forward tile flange 100, and an aft tile flange 102. The tile panel 98 has a thickness that is greater than a thickness of both the forward and aft liner flanges 100, 102.

The forward tile flange 100 is retained between a portion of the dome panel 40 and the inner wall 38 to block radial movement of the inner liner tile 50 relative to the combustor shell 26. The aft tile flange 102 is received in the channel 68 of the inner support ring 58. The aft tile flange 102 and the channel 68 are sized relative to one another to provide a slip fit therebetween to allow for thermal growth of the combustor shell 26 and the inner support ring 58 relative to the inner liner tile 50. With the combustor 20 grounded at a forward end of the outer wall 36, the inner support ring 58 is free to translate axially aft and relative to the inner liner tile 50 as the combustor shell 26 and the inner support ring 58 expand thermally.

Each of the plurality of outer liner tiles 52 extends axially aft from the dome panel 40 and runs the entire axial length of the internal space 32 as shown in FIGS. 4 and 5. Although the combustor 20 includes a plurality of outer liner tiles 52, each of the outer liner tiles 52 is substantially similar to one another. Accordingly, only one outer liner tile 52 is discussed herein.

The outer liner tile 52 includes a tile panel 104 and an aft tile flange 106. The tile panel 104 has a thickness that is greater than a thickness of the aft tile flange 106. A forward end 108 of the outer liner tile 52 seamlessly transitions to the heat shield 28 to form a one-piece component that includes the outer liner tile 52 and the heat shield 28. The aft tile flange 106 is received in the channel 76 of the outer support ring 60. The aft tile flange 106 and the channel 76 are sized relative to one another to provide a slip fit therebetween to allow for thermal growth of the combustor shell 26 and the outer support ring 60 relative to the outer liner tile 52. With the combustor 20 grounded at a forward end of the outer wall 36, the outer support ring 60 is free to translate axially aft and relative to the outer liner tile 52 as the combustor shell 26 and the outer support ring 60 expand thermally.

Figure 6:
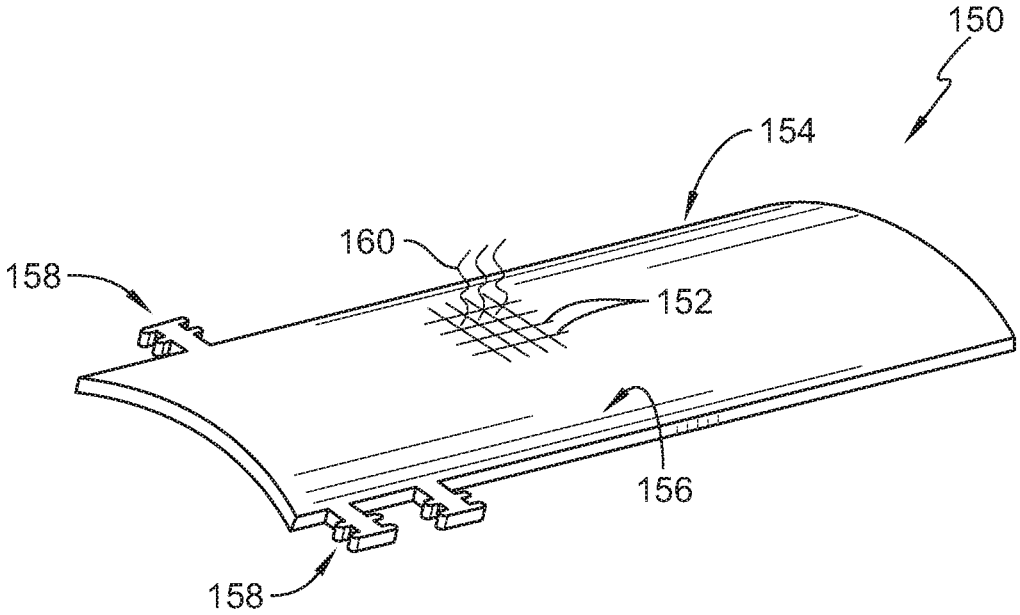
FIG. 6 is a perspective view of a ceramic preform including a plurality of ceramic fibers and suggesting that the ceramic fibers are infiltrated with a ceramic matrix material to densify the ceramic preform.
Figure 7:
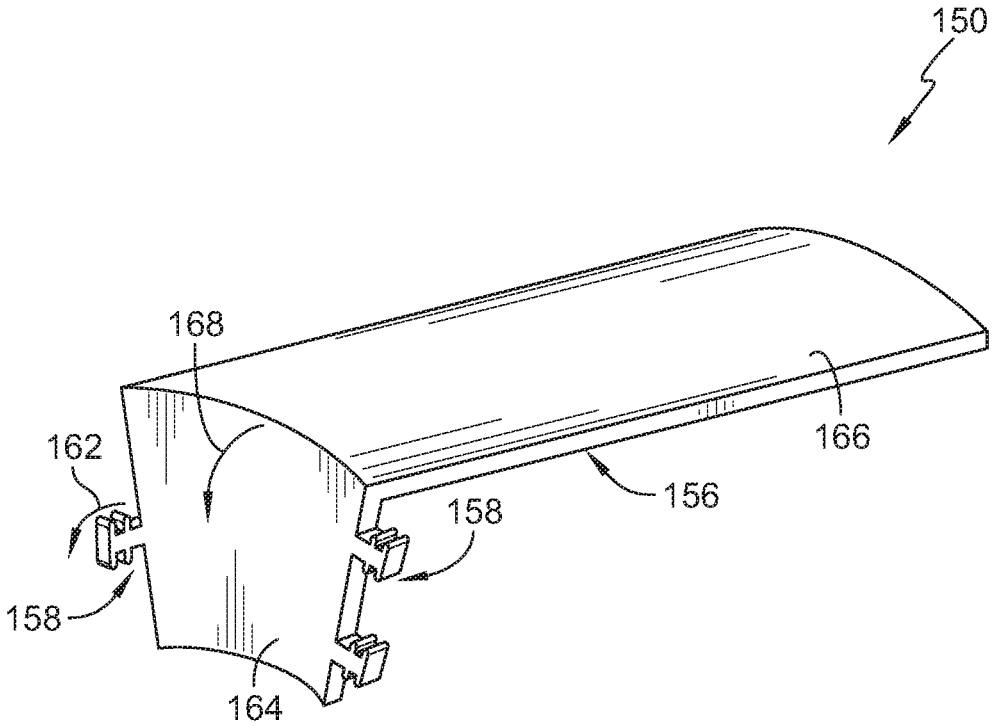
FIG. 7 is a perspective view of the ceramic preform being folded in a first direction to provide a heat shield section and a liner section and showing a plurality of protrusions being folded in a second direction so that they face away from the liner section.

The heat shield 28 and the combustor liner 30 are made from ceramic matrix composite materials that include a plurality of ceramic fibers suspended in ceramic matrix material. The heat shield 28 and the outer tile liner 52 are formed integral with one another during a manufacturing process that begins by forming a ceramic preform 150 as shown in FIGS. 6 and 7. The ceramic preform 150 includes a plurality of ceramic fibers 152 that are woven or braided together to form a ply 154 or a sheet. The plurality of ceramic fibers may be two-dimensionally or three-dimensionally woven or braided to form the ply 154. The ply 154 is shaped to include a rectangular portion 156 and a plurality of protrusions 158. The ply 154 may be shaped to include the rectangular portion 156 and the protrusions 158 as the ceramic fibers are woven or braded together. Alternatively, the ply 154 may be shaped to include the rectangular portion 156 and the protrusions 158 by molding or machining portions of the ply 154.

The ply 154 is infiltrated with ceramic matrix material 160 to at least partially densify the ply 154 so that the ply can be shaped to include the rectangular portion 156 and the protrusions 158 as shown in FIG. 6. The ceramic fibers 152 and the ceramic matrix material 160 may include silicon-carbide fibers in a silicon-carbide matrix, oxide fibers in an oxide matrix, or any other suitable ceramic matrix composite materials. Once at least partially densified, the rectangular portion 156 is folded in a first direction 162 to provide a heat shield section 164 and a tile section 166 as shown in FIG. 7. Each of the plurality of protrusions 158 are folded in a second direction 168 so that each protrusion 158 extends away from the tile section 166 to provide the attachments 91, 92, 93 once the CMC is finished.

Both the heat shield section 164 and the tile section 166 may be molded to include a curvature with an arc center that is about equal to the axis 25 of the gas turbine engine 10. The preform 150 may then be solidified to form the integrated heat shield 28 and outer liner tile 52. Some examples of a suitable solidification process include chemical vapor infiltration (CVI), polymer infiltration and pyrolysis (PIP), slurry melt infiltration (SMI), or any other suitable densification/solidification process. In some embodiments, the protrusions 158 may be formed by machining after the ceramic preform 150 is solidified.

Figure 8:
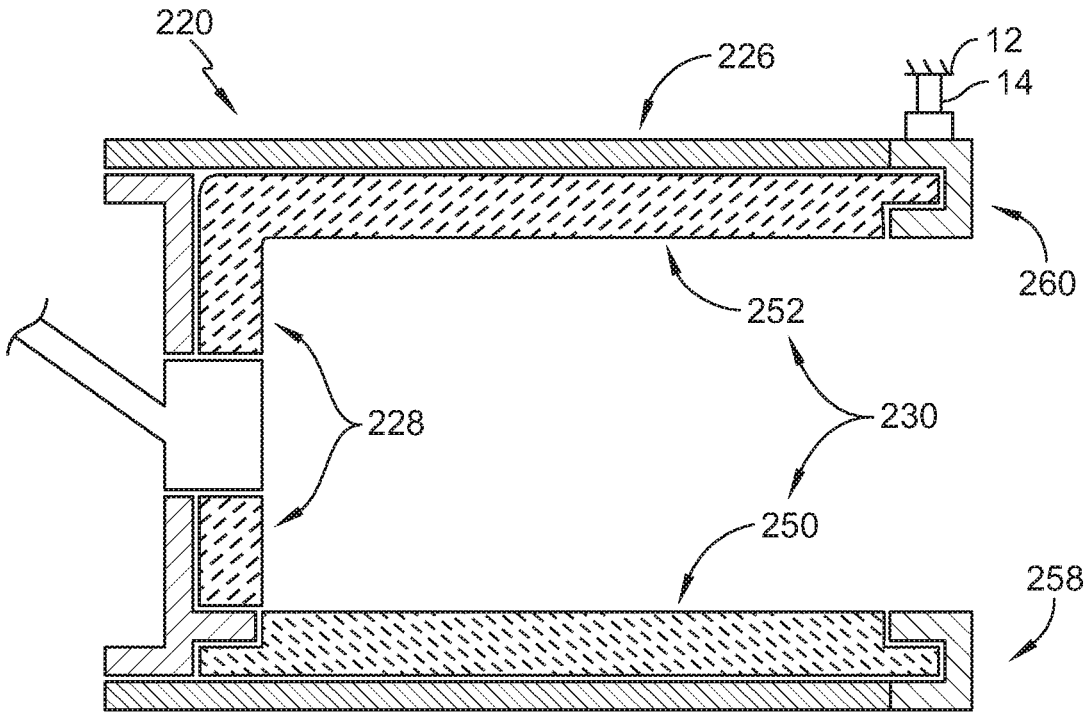
FIG. 8 is a cross sectional view of a second embodiment of a combustor similar to the combustor shown in FIG. 5 showing combustor grounded to the gas turbine engine at an axially-aft end of the combustor.

Another embodiment of a combustor 220 is shown in FIG. 8. The combustor 220 is substantially similar to combustor 20 shown in FIGS. 1-7. Reference numbers in the 200 series are used to indicate common features between combustor 220 and combustor 20. Accordingly, the disclosure of combustor 20 is incorporated by reference for combustor 220 except for the differences between combustor 220 and combustor 20 discussed below.

The combustor 220 is grounded to the outer case 12 of the gas turbine engine at an aft end of the combustor 220 using the outer support ring 260. While typical combustors are grounded at a forward end to accommodate thermal growth while avoiding breakage of heat shields and combustor liners, the combustor 220 provides the same benefit while being mounted at an aft end of the combustor 220. With the slip fit between the outer liner tile 252 and the outer support ring 260, the combustor liner 230 is able to translate relative to the combustor shell 226 as the combustor shell 226 moves axially forward due to thermal expansion. The heat shield 228 is pulled forward with the dome panel 240 as the combustor shell 226 expands while the slip fit between the outer liner tile 252 and the outer support ring 260 avoids binding stresses by allowing the combustor liner 230 to move relative to the combustor shell 226.

Figure 9:
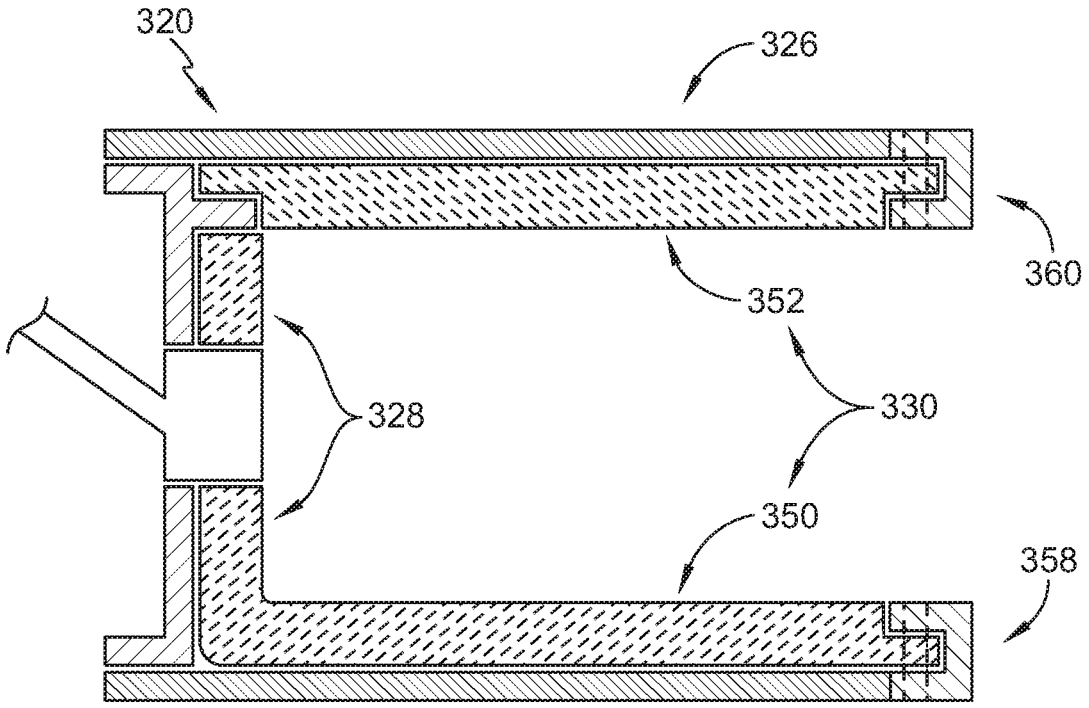
FIG. 9 is a cross sectional view of a third embodiment of a combustor similar to the combustor shown in FIG. 5 showing that the combustor includes a combustor shell, a heat shield, and a combustor liner having an outer liner tile and an inner liner tile that is integral with the heat shield.

Another embodiment of a combustor 320 is shown in FIG. 9. The combustor 320 is substantially similar to combustor 20 shown in FIGS. 1-7. Accordingly, similar reference numbers in the 300 series are used to indicate common features between combustor 320 and combustor 20. Accordingly, the disclosure of combustor 20 is incorporated by reference for combustor 320 except for the differences between combustor 320 and combustor 20 discussed below.

Combustor 320 includes a combustor shell 326, a heat shield 328, and a combustor liner 330. The combustor liner 330 includes an inner liner tile 350 and an outer liner tile 352. Unlike combustor 20, the inner liner tile 350 is formed integral with the heat shield 328. The combustor 320 functions in substantially the same manner as combustor 20 except that the heat shield 328 will move away from the outer liner tile 352 due to thermal expansion of the combustor shell 326.

Figure 10:
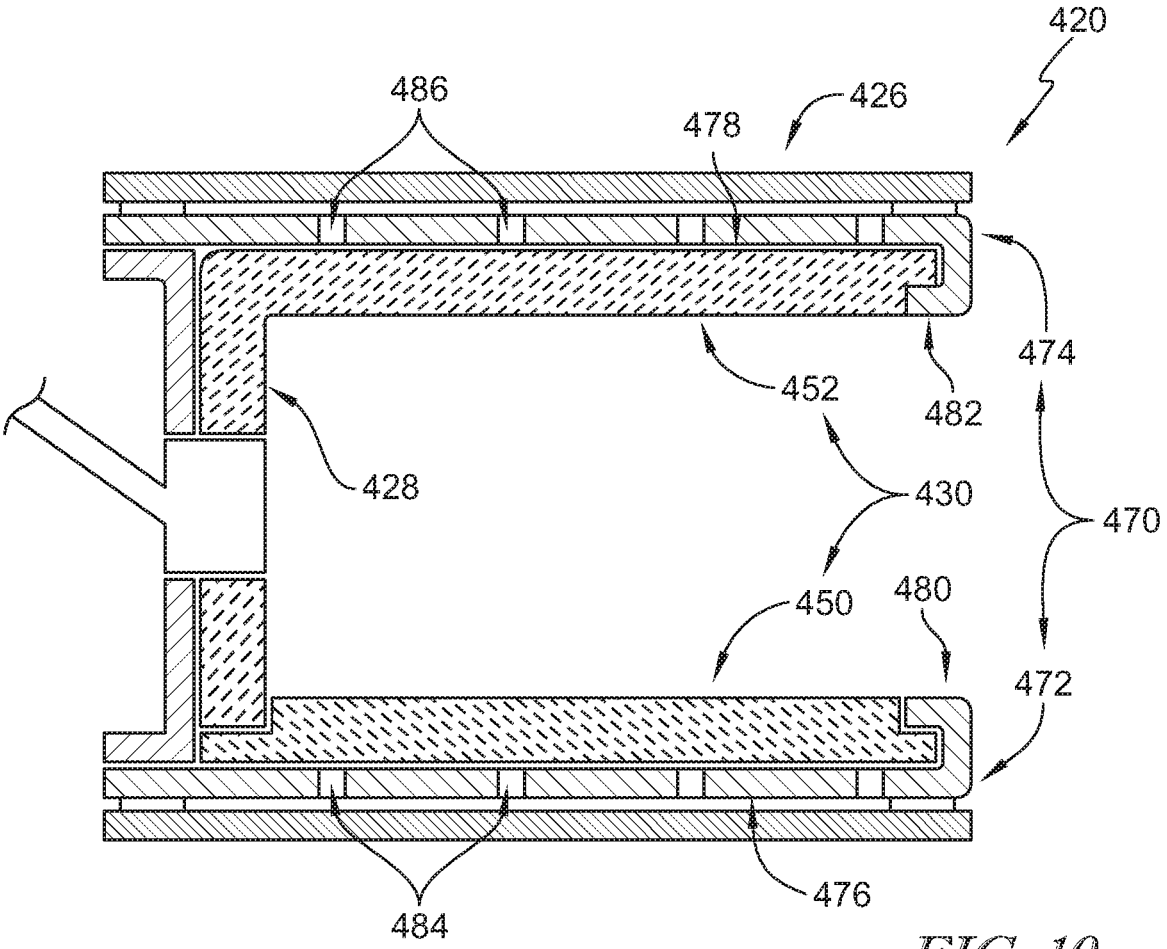
FIG. 10 is a cross sectional view of a fourth embodiment of a combustor similar to the combustor shown in FIG. 5 showing that the combustor includes a combustor shell, a heat shield, a combustor liner, and an inner combustor sleeve that retains the combustor liner to the combustor shell and is formed to include a plurality of axially extending cooling channels to direct cooling fluid onto the combustor liner.

Another embodiment of a combustor 420 is shown in FIG. 10. The combustor 420 is substantially similar to combustor 20 shown in FIGS. 1-7. Accordingly, similar reference numbers in the 400 series are used to indicate common features between combustor 420 and combustor 20. Accordingly, the disclosure of combustor 20 is incorporated by reference for combustor 420 except for the differences between combustor 420 and combustor 20 discussed below.

Combustor 420 includes a combustor shell 426, a heat shield 428, a combustor liner 430, and a liner skin 470. The combustor liner 430 includes an inner liner tile 450 and an outer liner tile 452. The liner skin 470 includes an inner liner skin 472 that is positioned between the inner liner tile 450 and the combustor shell 426 and an outer liner skin 474 that is positioned between the outer liner tile 452 and the combustor shell 426. Both the inner liner skin 472 and the outer liner skin 474 include a skin panel 476, 478, and a hanger 480, 482. The panels 476, 478 are formed to include a plurality of cooling passages 484, 486 to conduct cooling fluid onto the combustor liner 30. The hangers 480, 482 may be integral with or separate from panels 476, 478. The hangers 480, 482 are configured to retain aft ends of the inner and outer liner tiles 450, 452 in the same manner support rings 58, 60 retain inner and outer liner tiles 50, 52 in combustor 20.

Figure 11:
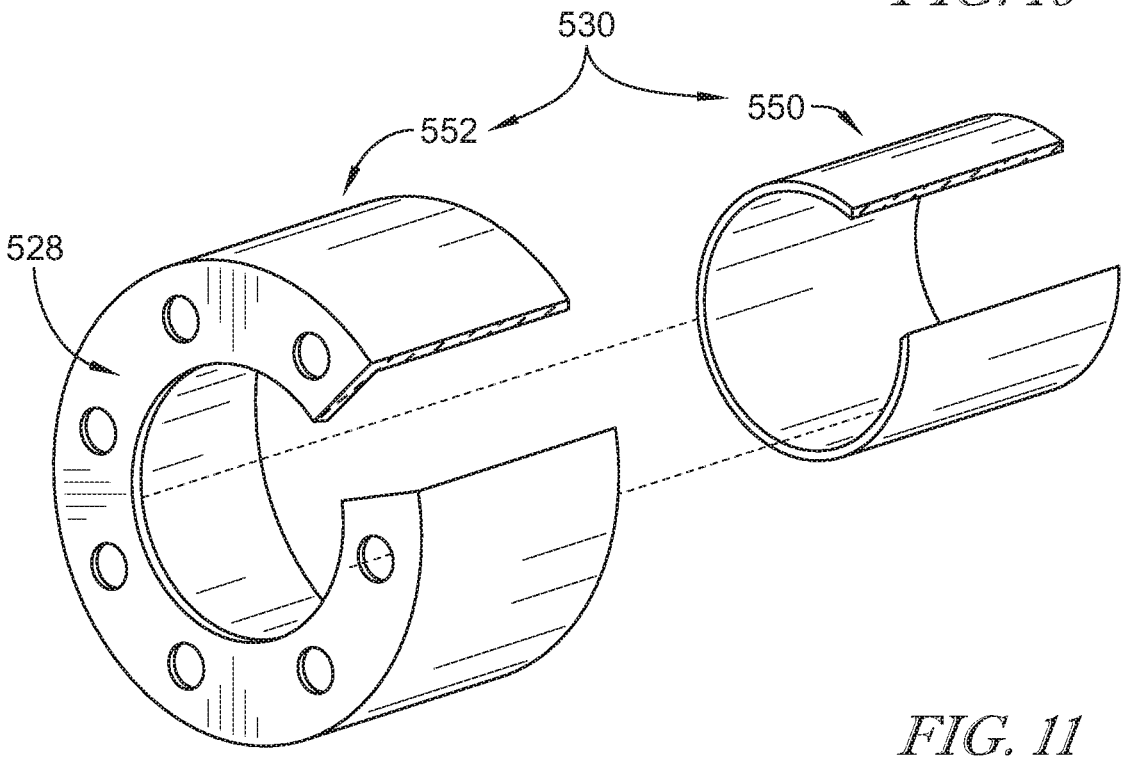
FIG. 11 is a exploded assembly view of another embodiment of a heat shield and a combustor liner for a combustor with a section cut away to show that the heat shield and the combustor liner are formed as a full hoop and the combustor liner includes an inner liter tile and an outer liner tile that is integral with the heat shield.

Another embodiment of a heat shield 528 and a combustor liner 530 that may be used with any one of combustors 20, 220, 320, 420 is shown in FIG. 11. The heat shield 528 and the combustor liner 530 are substantially similar to heat shield 28 and combustor liner 30. Accordingly, disclosure related to heat shield 28 and combustor liner 30 are incorporated herein for heat shield 528 and combustor liner 530 except the differences described below.

The heat shield 528 and the combustor liner 530 are formed from ceramic matrix composite materials as a full hoop as shown in FIG. 11. Forming the heat shield 528 and the combustor liner 530 as a full hoop minimized gaps between heat shields and tiles and seals that would be placed in the gaps to block fluid flow therebetween. The combustor liner 530 includes an inner liner tile 550 and an outer liner tile 552. The outer liner tile 552 is formed integral with the heat shield 528 while the inner liner tile 550 is separate from both the heat shield 528 and the outer liner tile 552. In some embodiments, the inner liner tile 550 may be formed integral with the heat shield 528 while the outer liner tile 552 is separate from both the heat shield 528 and the inner liner tile 550.

When a full hoop combustor liner is not used, liner tiles of the combustors 20, 220, 320, 420 may be formed to have a variety of shapes to block fluid flow between one another as shown in FIGS. 12-17. Only outer liner tiles are shown and described with reference to FIGS. 12-17, however, it should be noted that inner liner tiles may also include the features shown and described with reference to FIGS. 12-17.

Figure 12:
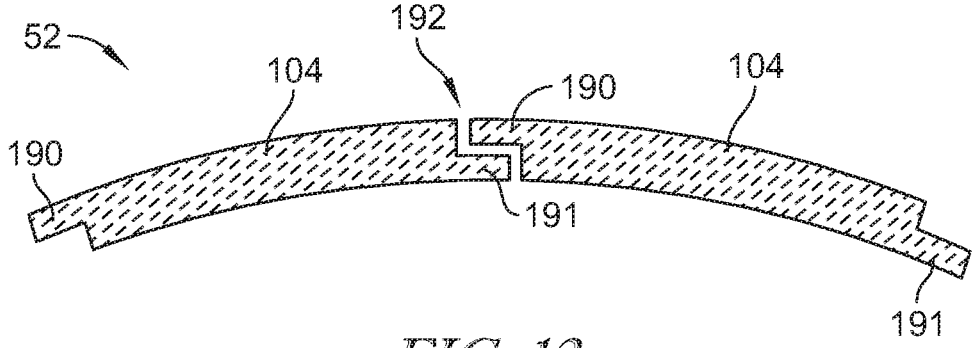
FIG. 12 is a cross sectional view of two combustor liner tiles looking in an axial direction showing that each combustor liner tile includes circumferentially-extending flanges that overlap one another to seal between radially inner and outer surfaces of each combustor liner tile.

Each outer liner tile 52 included in combustor 20 includes a first circumferentially-extending flange 190 and a second circumferential flange 191 as shown in FIG. 12. The first and second circumferentially-extending flanged 190, 191 are arranged on opposite inner and outer portions of the tile panel 104 such that they cooperate with neighboring outer liner tiles 52 to form a shiplap seal 192 therebetween. The shiplap seal 192 restricts fluid flow between each outer liner tile 52 while allowing the outer liner tiles to translate circumferentially apart from one another due to thermal growth of the combustor shell 26. Any one of combustors 20, 220, 320, and 420 may include outer liner tiles 52.

Figure 13:
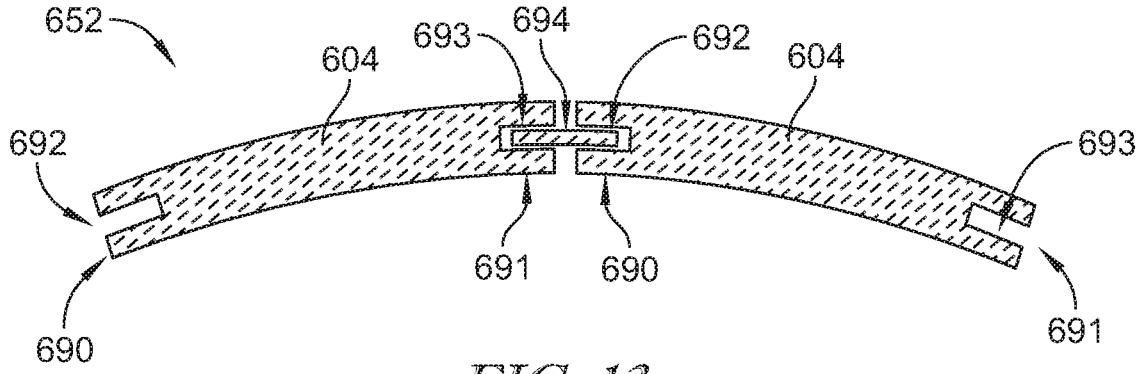
FIG. 13 is a cross sectional view of two combustor liner tiles of another embodiment of a combustor looking in an axial direction showing that each combustor liner tile includes circumferentially-extending flanges that define slots and receive a strip seal to seal circumferentially between each combustor liner tile.

Another embodiment of an outer liner tile 652 is shown in FIG. 13. Each liner tile 652 includes a tile panel 604, a first pair of circumferentially-extending flanges 690 and a second pair of circumferentially-extending flanges 691 on an opposite side of the tile panel 604 from the first pair of circumferentially-extending flanges 690. Both flanges of the first pair of circumferentially-extending flanges 690 are spaced radially from one another to provide a channel 692 therebetween. Both flanges of the second pair of circumferentially-extending flanges 691 are spaced radially from one another to provide a channel 693 therebetween. A strip seal 694 is arranged to fit within each channel 692, 693 to seal between each outer liner tile 652. Any one of combustors 20, 220, 320, and 420 may include outer liner tiles 652.

Figure 14:
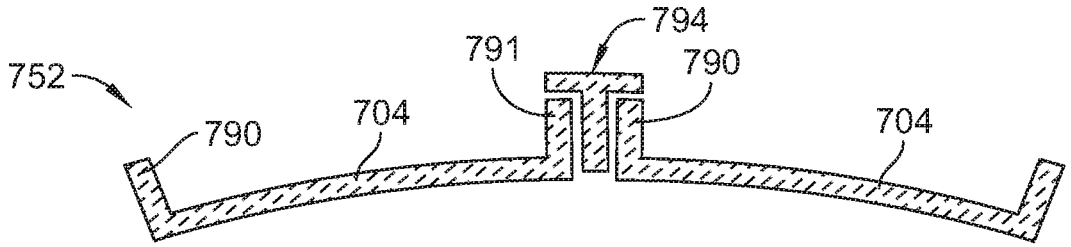
FIG. 14 is a cross sectional view of two combustor liner tiles of another embodiment of a combustor looking in an axial direction showing that each combustor liner tile includes radially-extending flanges and receive a T-shaped seal therebetween to seal circumferentially between each combustor liner tile.

Another embodiment of an outer liner tile 752 is shown in FIG. 14. Each liner tile 752 includes a tile panel 704, a first radially-extending flange 790 and a second radially-extending flange 791 on an opposite side of the tile panel 704 from the first radially-extending flange 790. A T-shaped seal 794 is arranged to fit between each outer liner tile 652 to block fluid flow between each of the outer liner tiles 752. Any one of combustors 20, 220, 320, and 420 may include outer liner tiles 752.

Figure 15:
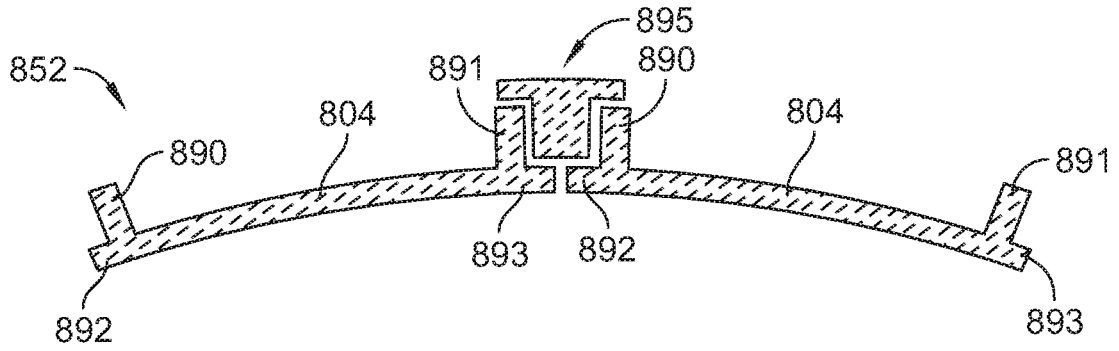
FIG. 15 is a cross sectional view of two combustor liner tiles of another embodiment of a combustor looking in an axial direction showing that each combustor liner tile includes radially-extending flanges and circumferentially-extending flanges and receive a T-shaped seal therebetween to seal circumferentially between each combustor liner tile.

Another embodiment of an outer liner tile 852 is shown in FIG. 15. Each liner tile 852 includes a tile panel 804, first and second radially-extending flanges 890, 891, and first and second circumferentially-extending flanges 892, 893. A T-shaped seal 894 is arranged to fit between a first and second radially-extending flange 890, 891 and above a first and second circumferentially-extending flange 892, 893 of neighboring outer liner tiles 852 to block fluid flow between each of the outer liner tiles 852. Any one of combustors 20, 220, 320, and 420 may include outer liner tiles 852.

Figure 16:
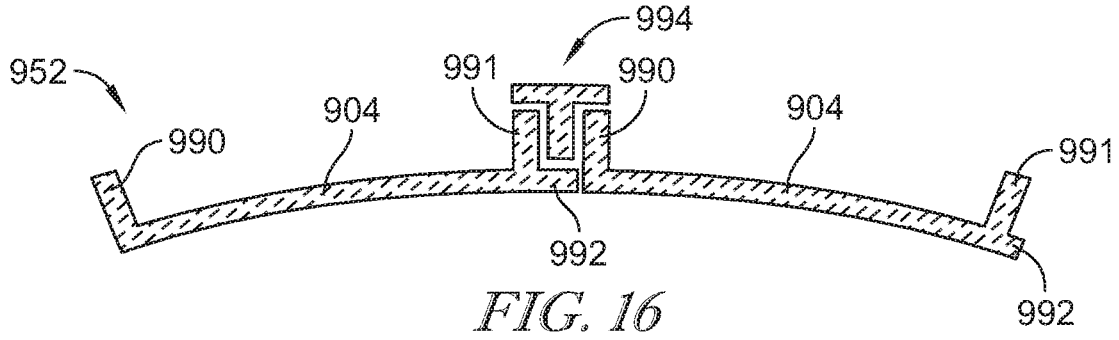
FIG. 16 is a cross sectional view of two combustor liner tiles of another embodiment of a combustor looking in an axial direction showing that each combustor liner tile includes radially-extending flanges and circumferentially-extending flanges and receive a T-shaped seal therebetween to seal circumferentially between each combustor liner tile.

Another embodiment of an outer liner tile 952 is shown in FIG. 16. Each liner tile 952 includes a tile panel 904, first and second radially-extending flanges 990, 991 on opposite sides of the tile panel 904, and a circumferentially-extending flange 992 on only one side of the tile panel 904. A T-shaped seal 994 is arranged to fit between a first and second radially-extending flange 990, 991 of neighboring outer liner tiles 952 and above the circumferentially-extending flange 892 of one of the outer liner tiles 952 to block fluid flow between each of the outer liner tiles 952. Any one of combustors 20, 220, 320, and 420 may include outer liner tiles 952.

Figure 17:
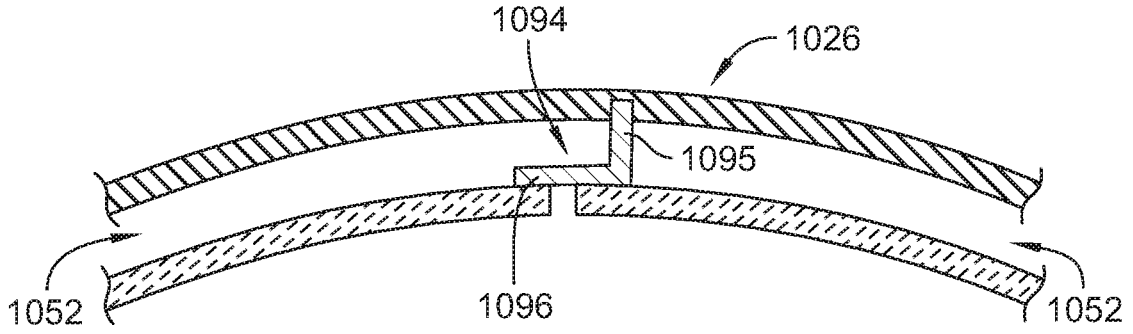
FIG. 17 is a cross sectional view of two combustor liner tiles of another embodiment of a combustor looking in an axial direction showing that each combustor liner tile has a substantially constant thickness across the entire combustor liner tile and the combustor further includes a spring loaded bracket that applies a force on the combustor liner tiles over a gap circumferentially between the combustor liner tiles.

Another embodiment of an outer liner tile 1052 is shown in FIG. 17. Each outer liner tile 1052 has a substantially constant thickness across the entire circumferential width of each outer liner tile 1052. A seal 1094 is mounted to a shell 1026 of the combustor and is biased into engagement with at least two outer liner tiles 1052 to cover an interface there between. The seat 1094 includes an radial portion 1095, and a circumferential portion 1096 that applied a radially load on the outer liner tiles 1052 to block fluid flow through the interface between the outer liner tiles 1052. Any one of combustors 20, 220, 320, and 420 may include outer liner tiles 1052.

In some embodiments, a CMC combustor liner (either inner or outer) is integrated with the heat shield. The combustor liner and the heat shield may be integrated together and split into a plurality of sectors circumferentially. The sectors may be made from CMC. The sectors may be captured at the front by attaching them to the dome panel and in the aft by supporting the sectors with a full hoop support ring. The combustor liner may be split into a plurality of tiles where the included angle of each tile would be 360/N and N is the number of tiles to be included. The actual angle may be reduced slightly by an amount to account for the tolerance stack to ensure that the sectors can be fitted together in the assembly. Each tile includes an axial portion that acts as the combustion liner. At the front of the tile, the liner would turn to seamlessly form the heat shield. The heat shield portion would include a hole to receive the burner seal/fuel nozzle and may include a plurality of retention features that are used to secure the liner/shield to the dome panel. The retention features may take the form of fasteners.

In some embodiments, the combustor may include an outer metallic skin. This outer skin may either attach to (via bolts, pins, or clips) or be integral with the aft support ring. The outer skin may extend forward from the aft support ring to the dome panel. The outer skin may be attached to the dome panel with pins, bolts, or clips. A slip fit may be included between the outer metallic skin and the CMC liner due to differences in coefficients of thermal expansion between them. A slip fit may be at the interface of the CMC liner and the aft support ring.

In some embodiments, the liner may be integrated with the heat shield and formed as a full hoop liner/heat shield. The outer metallic skin may also be included in such an embodiment or may be a single skin liner. With a full hoop liner, the integral retention features may not be included with the heat shield. The liner may be axially retained by the aft support ring and could be radially supported with cross keys. In order to seal between individual sectors, the tiles could form a ship-lap seal, a strip seal could be used, or any other suitable seal could be used.

In some embodiments, the combustor liner disclosed herein reduces a part count and the overall cost of the combustor by integrating the heat shield with the liner. An outer skin layer, typically included between the combustor liner and the combustor shell, may be eliminated by using the combustor liner disclosed herein. The combustor liner disclosed herein may also reduce the number of leakage paths between the heat shield and the liner.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A combustor for use in a gas turbine engine, the combustor comprising a combustor shell comprising metallic materials, the combustor shell formed to define an internal space, the combustor shell including an inner annular wall that extends circumferentially around an axis, an outer annular wall that extends circumferentially around the axis and the inner annular wall to provide the internal space radially between the inner annular wall and the outer annular wall, and a dome panel that extends circumferentially around the axis and radially between an axially-forward end of the inner annular wall and an axially-forward end of the outer annular wall, a plurality of heat shields comprising ceramic matrix composite materials, each heat shield being mounted to an axially aft surface of the dome panel and arranged to extend partway around the axis, and a combustor liner arranged to extend along inner surfaces of the combustor shell within the internal space and to cooperate with the heat shield to define a combustor chamber, the combustor liner comprising ceramic matrix composite materials and including a plurality of outer liner tiles each arranged to extend only partway around the axis and axially away from the heat shield along the outer annular wall and a plurality of inner liner tiles each arranged to extend only partway around the axis and axially away from the heat shield along the inner annular wall, wherein one of the inner liner tile and the outer liner tile is formed integrally with the heat shield such that an axially-forward end of the one of the inner liner tile and the outer liner tile is supported by the heat shield relative to the combustor shell within the internal space and to block flow of gases between the heat shield and the one of the inner liner tile and the outer liner tile without a seal therebetween, further comprising an inner support ring that extends circumferentially around the axis and includes a first ring body, a first inner flange that extends axially from the first ring body along a radially inner surface of each of the inner liner tiles, and a first outer flange that extends axially from the first ring body along a radial outer surface of each of the inner liner tiles to block radial outward movement of the plurality of inner liner tiles and an outer support ring that extends circumferentially around the axis and includes a second ring body, a second outer flange that extends axially away from the second ring body and along a radially outer surface of each of the outer liner tiles, and a second inner flange that extends axially away from the second ring body along a radial inner surface of each of the outer liner tiles to block radial inward movement of the plurality of outer liner tiles, wherein the first inner flange is fixed with the inner annular wall and is spaced apart radially from the first outer flange to define a first channel therebetween, and the second outer flange is fixed with the outer annular wall and spaced apart radially from the second inner flange to define a second channel therebetween, and wherein a radially outermost surface of the first outer flange is a first radial distance from the axis and a radially outermost surface of each of the inner liner tiles is the first radial distance from the axis, and a radially innermost surface of the second inner flange is a second radial distance from the axis and a radially innermost surface of each of the outer liner tiles is the second radial distance from the axis.

2. The combustor of claim 1, wherein each outer liner tile is formed integral with a corresponding heat shield and each outer liner tile includes a tile panel and an aft support flange that extends axially-aft away from the tile panel to engage with the outer support ring with a slip fit.

3. The combustor of claim 2, wherein each outer liner tile further comprises a first circumferential flange on a first circumferential side of the tile panel and a second circumferential flange on an opposite second circumferential side of the tile panel and both the first circumferential flange and the second circumferential flange interlock with circumferential flanges of neighboring outer liner tiles to block flow of gases circumferentially between each outer liner tile.

4. The combustor of claim 2, wherein each inner liner tile includes a tile panel, a forward tile flange retained between the inner annular wall and the dome panel, and an aft tile flange retained by the inner support ring with a slip fit.

5. The combustor of claim 1, wherein each of the plurality of heat shields includes a shield panel and a plurality of attachments that extend axially forward from the shield panel and couple with the dome panel to mount and retain the heat shield and the corresponding one of the inner liner tile and the outer liner tile to the dome panel.

6. The combustor of claim 5, wherein each of the plurality of attachments extend through openings formed in the dome panel that are shaped to allow for thermal growth of the dome panel relative to the heat shield.

7. The combustor of claim 1, further comprising a plurality of first fasteners that extend radially through the plurality of inner liner tiles and into the inner support ring and a plurality of second fasteners that extend radially through the plurality of outer liner tiles and into the outer support ring.

8. The combustor of claim 7, wherein each of the plurality of inner liner tiles are formed to include elongated openings that receive the plurality of first fasteners and each of the plurality of outer liner tiles are formed to include elongated openings that receive the plurality of second fasteners.

9. The combustor of claim 8, wherein each inner liner tile includes an inner tile panel and an aft inner tile flange that extends axially away from the inner tile panel and into the first channel with a slip fit, each outer liner tile includes an outer tile panel and an aft outer tile flange that extends axially away from the outer tile panel and into the second channel with a slip fit, each inner tile panel has a thickness that is greater than a thickness of each aft inner tile flange, and each outer tile panel has a thickness that is greater than a thickness of each aft outer tile flange.

10. The combustor of claim 1, wherein each inner liner tile includes an inner tile panel and an aft inner tile flange that extends axially away from the inner tile panel and into the first channel with a slip fit, each outer liner tile includes an outer tile panel and an aft outer tile flange that extends axially away from the outer tile panel and into the second channel with a slip fit, each inner tile panel has a thickness that is greater than a thickness of each aft inner tile flange, and each outer tile panel has a thickness that is greater than a thickness of each aft outer tile flange.

11. The combustor of claim 1, wherein a forward axial wall of the first inner flange is fixed with an aft axial wall of the inner annular wall and a forward axial wall of the second outer flange is fixed with an aft axial wall of the outer annular wall.

12. A combustor for use in a gas turbine engine, the combustor comprising a combustor shell comprising metallic materials, the combustor shell extends circumferentially around an axis and is formed to define an internal space, a plurality of heat shields comprising ceramic matrix composite materials, each heat shield being mounted to the combustor shell within the internal space, and a combustor liner arranged to extend along inner surfaces of the combustor shell within the internal space and to cooperate with the heat shield to define a combustor chamber, the combustor liner comprising ceramic matrix composite materials and including a plurality of outer liner tiles arranged to extend axially away from the heat shield and a plurality of inner liner tiles arranged to extend axially away from the plurality of heat shields and spaced radially inward from the plurality of outer liner tiles, wherein one of the plurality of inner liner tiles and the plurality of outer liner tiles are formed integrally with a corresponding one of the plurality of heat shields such that an axially-forward end of the one of the plurality of inner liner tiles and the plurality of outer liner tiles is supported by the corresponding one of the plurality of heat shields relative to the combustor shell within the internal space, further comprising a liner skin comprising metallic materials and extending axially from the plurality of heat shields to a terminal aft end of the combustor liner, the liner skin including an inner liner skin that includes an inner skin panel and an inner hanger and an outer liner skin that includes an outer skin panel and an outer hanger, the inner skin panel being located radially between the plurality of inner liner tiles and an inner wall of the combustor shell, the inner hanger extending radially outward away from the inner skin panel and axially forward along a radially outermost surface of the inner liner tiles to block radially outward movement of the inner liner tiles, the outer skin panel being located radially between the plurality of outer liner tiles and an outer wall of the combustor shell, and the outer hanger extends radially inward away from the outer skin panel and axially forward along a radially innermost surface of the outer liner tiles to block radially inward movement of the outer liner tiles.

13. The combustor of claim 12, wherein each outer liner tile is formed integral with the corresponding heat shield and each outer liner tile includes a tile panel and an aft support flange that extends axially-aft away from tile panel to engage with the outer hanger with a slip fit and wherein each inner liner tile includes a tile panel, a forward tile flange retained by the combustor shell, and an aft tile flange retained by the inner hanger with a slip fit.

14. The combustor of claim 13, wherein each outer liner tile further comprises a first circumferential flange on a first circumferential side of the tile panel and a second circumferential flange on an opposite second circumferential side of the tile panel and both the first circumferential flange and the second circumferential flange interlock with circumferential flanges of neighboring outer liner tiles to block flow of gases circumferentially between each outer liner tile.

15. The combustor of claim 12, wherein each of the plurality of heat shields includes a shield panel and a plurality of attachments that extend axially forward from the shield panel and couple with the combustor shell to mount and retain the heat shield and the corresponding one of the inner liner tile and the outer liner tile to the combustor shell.

16. The combustor of claim 15, further including a dome panel and wherein each of the plurality of attachments extend through openings formed in the dome panel that are shaped to allow for thermal growth of the dome panel relative to the heat shield.

17. The combustor of claim 12, wherein the inner liner skin is formed to include a plurality of inner cooling passages that extend radially through the inner liner skin and the outer liner skin is formed to include a plurality of outer cooling passages that extend radially through the outer liner skin.

18. The combustor of claim 12, wherein each inner liner tile includes an inner tile panel and an aft inner tile flange that extends axially away from the inner tile panel and into the inner hanger, each outer liner tile includes an outer tile panel and an aft outer tile flange that extends axially away from the outer tile panel and into the outer hanger, each inner tile panel has a thickness that is greater than a thickness of each aft inner tile flange, and each outer tile panel has a thickness that is greater than a thickness of each aft outer tile flange.

19. The combustor of claim 12, wherein a radially outermost surface of the inner hanger is a first radial distance from the axis and a radially outermost surface of each of the inner liner tiles is the first radial distance from the axis, and a radially innermost surface of the outer hanger is a second radial distance from the axis and a radially innermost surface of each of the outer liner tiles is the second radial distance from the axis.

* * * * *